US011692299B2

(12) United States Patent
Salameh et al.

(10) Patent No.: US 11,692,299 B2
(45) Date of Patent: Jul. 4, 2023

(54) DRYER APPLIANCE AND METHODS FOR IMPROVED OPERATION

(71) Applicant: Haier US Appliance Solutions, Inc., Wilmington, DE (US)

(72) Inventors: Nemetalla Salameh, Louisville, KY (US); Khalid Jamal Mashal, Louisville, KY (US); Jose Efren Rodriguez Munoz, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 250 days.

(21) Appl. No.: 17/095,125

(22) Filed: Nov. 11, 2020

(65) Prior Publication Data

US 2022/0145524 A1 May 12, 2022

(51) Int. Cl.

| | |
|---|---|
| ***D06F 58/30*** | (2020.01) |
| ***D06F 34/05*** | (2020.01) |
| ***D06F 101/16*** | (2020.01) |
| ***D06F 103/04*** | (2020.01) |
| ***D06F 103/08*** | (2020.01) |
| ***D06F 103/06*** | (2020.01) |

(52) U.S. Cl.

CPC ..... *D06F 58/30* (2020.02); *D06F 34/05* (2020.02); *D06F 2101/16* (2020.02); *D06F 2103/04* (2020.02); *D06F 2103/06* (2020.02); *D06F 2103/08* (2020.02)

(58) Field of Classification Search

CPC ..... D06F 58/30; D06F 34/05; D06F 2103/08; D06F 2103/04; D06F 2103/06; D06F 2101/16

USPC ..... 34/528, 595–610

See application file for complete search history.

(56) References Cited

U.S. PATENT DOCUMENTS

| | | | | |
|---|---|---|---|---|
| 5,899,005 | A * | 5/1999 | Chen | D06F 58/38 34/535 |
| 6,954,995 | B2 * | 10/2005 | Kitamura | D06F 58/203 34/597 |
| 7,017,282 | B2 * | 3/2006 | Pyo | D06F 58/24 68/18 C |
| 7,096,601 | B2 * | 8/2006 | Lyu | D06F 29/00 34/595 |
| 7,383,644 | B2 | 6/2008 | Lyu et al. | |
| 8,688,530 | B2 * | 4/2014 | Ebrom | G06Q 30/02 705/26.1 |
| 9,745,688 | B2 * | 8/2017 | Ashrafzadeh | D06F 58/36 |

(Continued)

FOREIGN PATENT DOCUMENTS

| | | |
|---|---|---|
| CN | 107104860 A | 8/2017 |
| CN | 110699909 A | 1/2020 |

(Continued)

*Primary Examiner* — Stephen M Gravini

(74) *Attorney, Agent, or Firm* — Dority & Manning, P.A.

(57) ABSTRACT

A method of operating a dryer appliance is provided that includes obtaining washer operating parameters from a washing machine appliance that is linked to the dryer appliance and obtaining dryer operating parameters of the dryer appliance. These parameters are transmitted to a remote server along with a user input such as a selected dryness level. The method further includes receiving operating instructions from the remote server and adjusting at least one operating parameter of the dryer appliance based on the operating instructions.

20 Claims, 5 Drawing Sheets

(56) References Cited

U.S. PATENT DOCUMENTS

| | | | | |
|---|---|---|---|---|
| 10,087,572 | B2 * | 10/2018 | Bilionis | D06F 33/46 |
| 10,174,452 | B2 * | 1/2019 | Choi | D06F 58/10 |
| 10,472,760 | B2 * | 11/2019 | Ashrafzadeh | D06F 58/36 |
| 10,760,203 | B2 * | 9/2020 | Seo | D06F 58/36 |
| 10,995,448 | B2 * | 5/2021 | Masters | D06F 58/04 |
| 2002/0017117 | A1 * | 2/2002 | Sunshine | D06F 29/005 68/3 R |
| 2017/0183811 | A1 | 6/2017 | Kang et al. | |
| 2019/0003976 | A1 | 1/2019 | Clark | |
| 2020/0032449 | A1 | 1/2020 | Scheckelhoff et al. | |
| 2022/0034015 | A1 * | 2/2022 | David | D06F 39/02 |
| 2022/0145524 | A1 * | 5/2022 | Salameh | D06F 58/36 |
| 2022/0213633 | A1 * | 7/2022 | Zattin | D06F 39/022 |
| 2022/0282417 | A1 * | 9/2022 | Masciovecchio | D06F 21/02 |
| 2022/0380966 | A1 * | 12/2022 | Cook, IV | D06F 34/18 |

FOREIGN PATENT DOCUMENTS

| | | | | |
|---|---|---|---|---|
| EP | 2894251 | A2 * | 7/2015 | D06F 58/04 |
| JP | 2003/275493 | A | 9/2003 | |
| KR | 20150081602 | A * | 7/2015 | |

* cited by examiner

DRYER APPLIANCE AND METHODS FOR IMPROVED OPERATION

FIELD OF THE INVENTION

The present subject matter relates generally to laundry appliances, and more particularly, to dryer appliances and methods of improving dryer operation based on washing machine performance.

BACKGROUND OF THE INVENTION

Laundry appliances, such as washing machine appliances and dryer appliances, are commonly used to wash and dry, respectively, a load of clothes. Specifically, washing machine appliances generally include a wash tub for containing water or wash fluid and a wash basket rotatably mounted within the wash tub for receiving the load of clothes. These washing machines are typically equipped to operate in one or more modes or cycles, such as wash, rinse, and spin cycles. After the washing machine processes are complete, the load of clothes is moved over the to the dryer, which includes a cabinet with a drum rotatably mounted therein and a heating assembly that supplies heated air into a chamber of the drum, e.g., through a duct mounted to a back wall of the drum, to facilitate a drying process.

Notably, the overall performance of a laundry system may be improved by sharing cycle information and operating performance between the washer and dryer. For example, drying performance may be improved if the dryer is provided with details related to the wash cycle performed by the washing machine. However, the complex interrelationships between the various parameters monitored or controlled in each appliance, the user inputs, the wash load size or type, etc. may only be stored in complex data tables or in computationally intensive transfer functions or algorithms. The storage of such data and algorithms often occupies much of the data storage available on the local controllers of the laundry appliances.

Accordingly, a laundry appliance system with improved data storage and interaction for improved performance would be useful. More specifically, a method of using operating parameters of the washing machine appliance and process to facilitate improved operation of a dryer appliance in a manner that reduces the need for onboard data storage and computations would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a dryer appliance is provided, including a cabinet, a drum rotatably mounted within the cabinet, the drum defining a chamber for receipt of clothes for drying, and a controller communicatively coupled to a remote server. The controller is configured to obtain washer operating parameters from a washing machine appliance that is linked to the dryer appliance, obtain dryer operating parameters of the dryer appliance, transmit the washer operating parameters and the dryer operating parameters to the remote server, receive operating instructions from the remote server, and adjust at least one operating parameter of the dryer appliance based on the operating instructions.

In another exemplary embodiment, a method of operating a dryer appliance is provided. The dryer appliance includes a drum rotatably mounted within a cabinet, the drum defining a chamber for receipt of clothes for drying. The method includes obtaining washer operating parameters from a washing machine appliance that is linked to the dryer appliance, obtaining dryer operating parameters of the dryer appliance, transmitting the washer operating parameters and the dryer operating parameters to a remote server, receiving operating instructions from the remote server, and adjusting at least one operating parameter of the dryer appliance based on the operating instructions.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
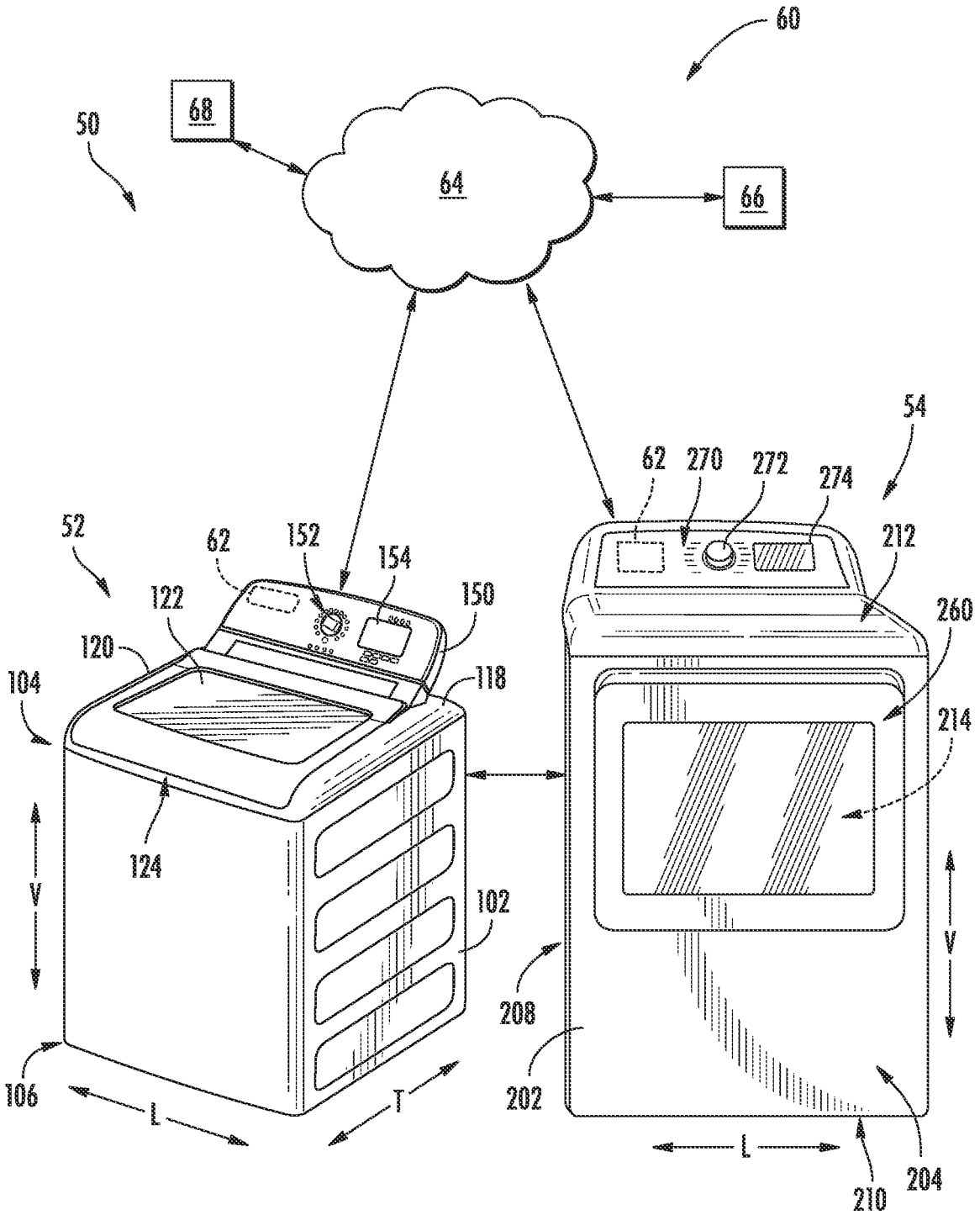
FIG. 1 provides a schematic representation of a laundry appliance system that includes a washing machine appliance, a dryer appliance, and an external communication system according to an exemplary embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates a laundry appliance system 50 according to exemplary embodiments of the present subject matter. As shown, laundry appliance system 50 generally includes a washing machine appliance 52 and a dryer appliance 54, for washing and drying clothes, respectively. Each of washing machine appliance 52 and dryer appliance 54 will be described below according to exemplary embodiments of the present subject matter. Specifically, these figures illustrate various views of washing machine 52 and dryer appliance 54 in order to facilitate discussion regarding the use and operation of laundry system 50. However, it should be appreciated that the specific appliance configurations illustrated and described are only exemplary, and the scope of the present subject matter is not limited to the configurations set forth herein. Furthermore, it should be appreciated that like reference numerals may be used to refer to the same or similar features between washing machine 52 and dryer appliance 54.

Referring still to FIG. 1, a schematic diagram of an external communication system 60 will be described according to an exemplary embodiment of the present subject matter. In general, external communication system 60 is configured for permitting interaction, data transfer, and other communications between and among washing machine 52, dryer appliance 54, and/or a user of such appliances. For example, this communication may be used to provide and receive operating parameters, cycle settings, performance characteristics, user preferences, or any other suitable information for improved performance of laundry system 50.

As illustrated, each of washing machine appliance 52 and dryer appliance 54 may include a controller 62 (described in more detail below). External communication system 60 permits controllers 62 of washer appliance 52 and dryer appliance 54 to communicate with external devices either directly or through a network 64. For example, a consumer may use a consumer device 66 to communicate directly with washing machine 52 and/or dryer appliance 54. Alternatively, these appliances may include user interfaces for receiving such input (described below). For example, consumer devices 66 may be in direct or indirect communication with washing machine 52 and dryer appliance 54, e.g., directly through a local area network (LAN), Wi-Fi, Bluetooth, Zigbee, etc. or indirectly through network 64. In general, consumer device 66 may be any suitable device for providing and/or receiving communications or commands from a user. In this regard, consumer device 66 may include, for example, a personal phone, a tablet, a laptop computer, or another mobile device.

In addition, a remote server 68 may be in communication with washing machine 52, dryer appliance 54, and/or consumer device 66 through network 64. In this regard, for example, remote server 68 may be a cloud-based server 68, and is thus located at a distant location, such as in a separate state, country, etc. In general, communication between the remote server 68 and the client devices may be carried via a network interface using any type of wireless connection, using a variety of communication protocols (e.g. TCP/IP, HTTP, SMTP, FTP), encodings or formats (e.g. HTML, XML), and/or protection schemes (e.g. VPN, secure HTTP, SSL).

In general, network 64 can be any type of communication network. For example, network 64 can include one or more of a wireless network, a wired network, a personal area network, a local area network, a wide area network, the internet, a cellular network, etc. According to an exemplary embodiment, consumer device 66 may communicate with a remote server 68 over network 64, such as the internet, to provide user inputs, transfer operating parameters or performance characteristics, etc. In addition, consumer device 66 and remote server 68 may communicate with washing machine 52 and dryer appliance 54 to communicate similar information.

External communication system 60 is described herein according to an exemplary embodiment of the present subject matter. However, it should be appreciated that the exemplary functions and configurations of external communication system 60 provided herein are used only as examples to facilitate description of aspects of the present subject matter. System configurations may vary, other communication devices may be used to communicate directly or indirectly with one or more laundry appliances, other communication protocols and steps may be implemented, etc. These variations and modifications are contemplated as within the scope of the present subject matter.

Figure 2:
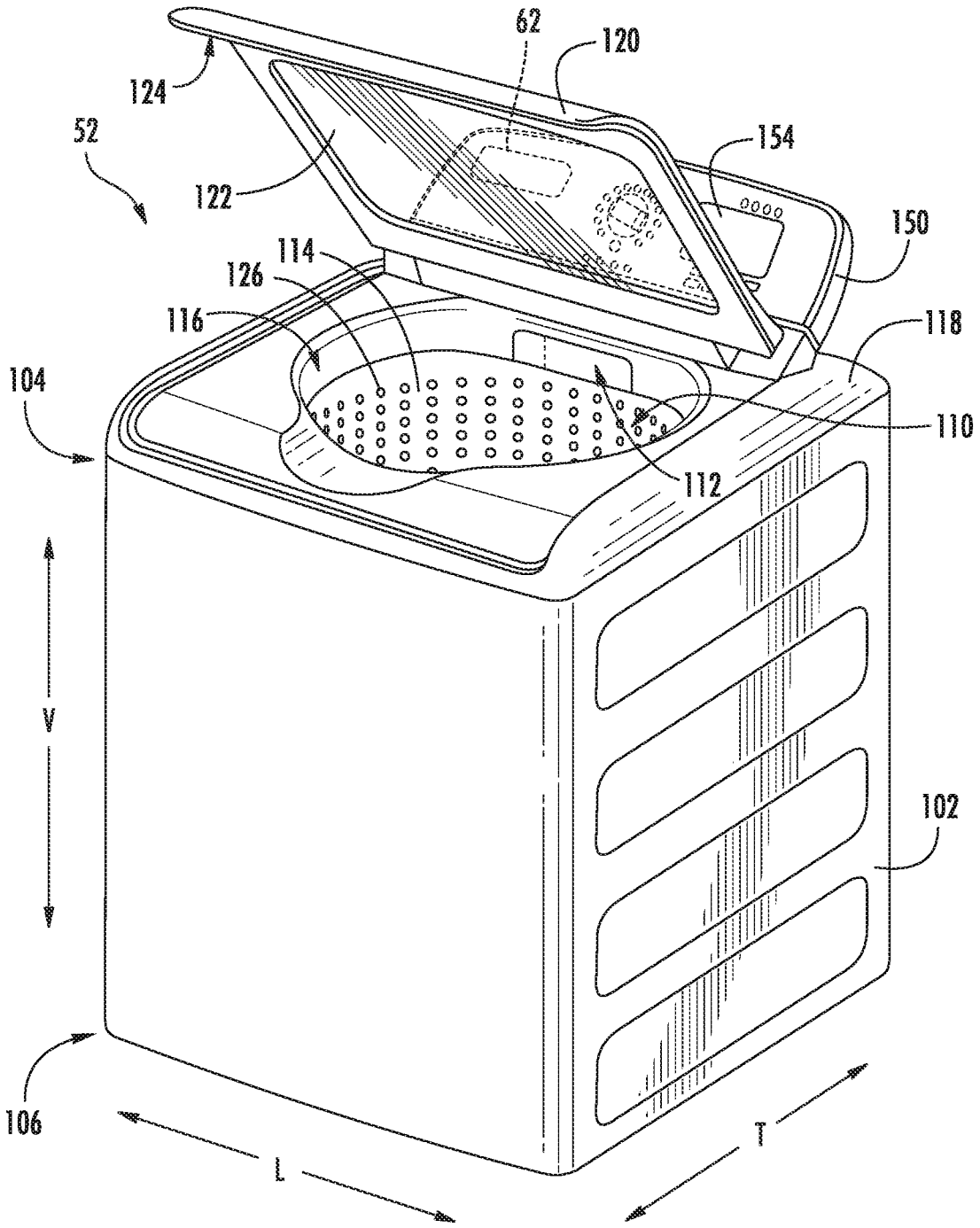
FIG. 2 provides a perspective view of the exemplary washing machine appliance of FIG. 1 with the door of the exemplary washing machine appliance shown in an open position.
Figure 3:
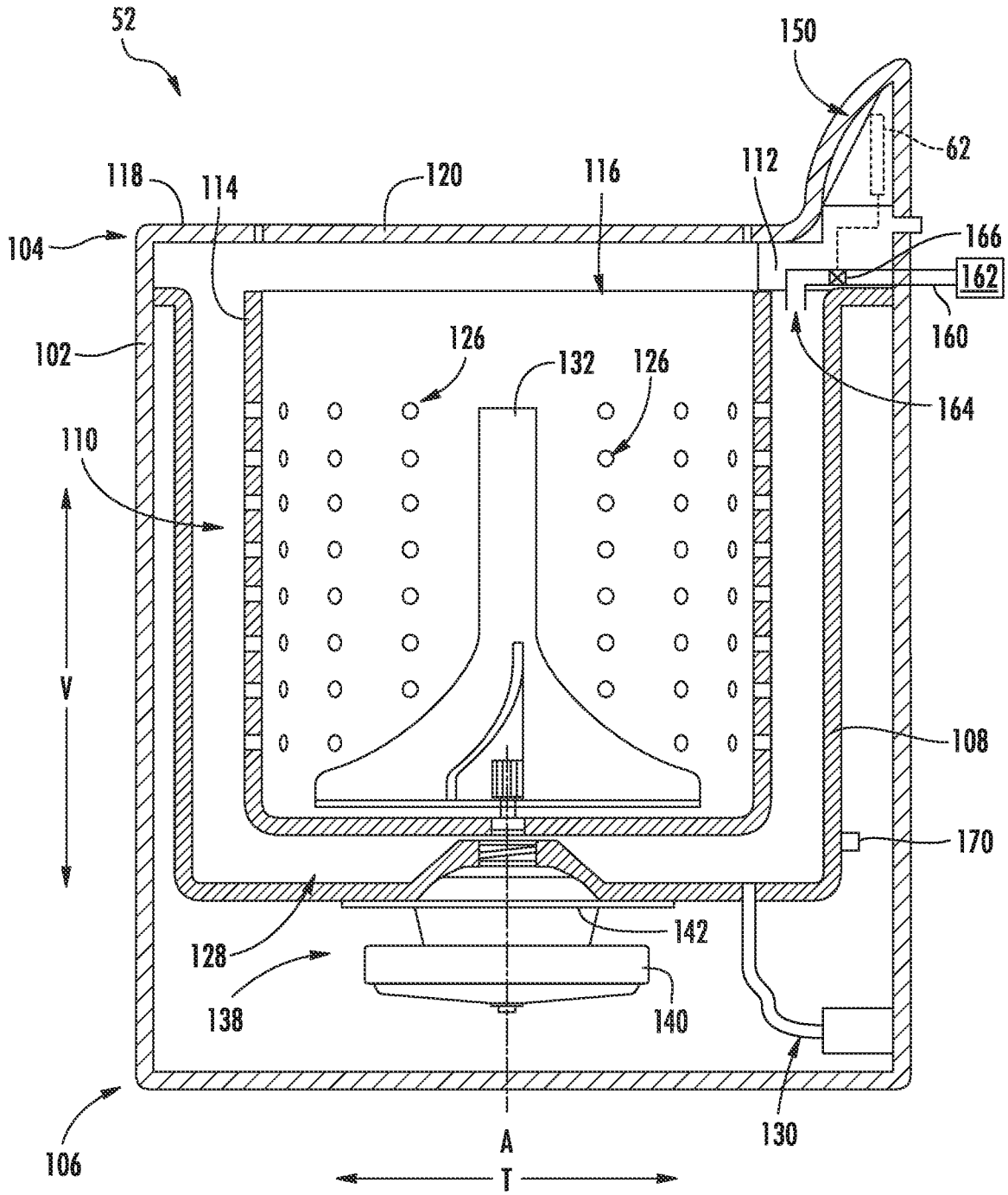
FIG. 3 provides a side cross-sectional view of the exemplary washing machine appliance of FIG. 1.

Referring now also to FIGS. 2 and 3, washing machine appliance 52 will be described according to an exemplary embodiment of the present subject matter. Specifically, these figures illustrate an exemplary embodiment of a vertical axis washing machine appliance 52. Specifically, FIGS. 1 and 2 illustrate perspective views of washing machine appliance 52 in a closed and an open position, respectively. FIG. 3 provides a side cross-sectional view of washing machine appliance 52. Washing machine appliance 52 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 52, it should be appreciated that vertical axis washing machine appliance 52 is provided by way of example only. It will be understood that aspects of the present subject matter may be used in any other suitable washing machine appliance, such as a horizontal axis washing machine appliance. Indeed, modifications and variations may be made to washing machine appliance 52, including different configurations, different appearances, and/or different features while remaining within the scope of the present subject matter.

Washing machine appliance 52 has a cabinet 102 that extends between a top portion 104 and a bottom portion 106 along the vertical direction V, between a first side (left) and a second side (right) along the lateral direction L, and between a front and a rear along the transverse direction T. As best shown in FIG. 3, a wash tub 108 is positioned within cabinet 102, defines a wash chamber 110, and is generally configured for retaining wash fluids during an operating cycle. Washing machine appliance 52 further includes a primary dispenser 112 (FIG. 2) for dispensing wash fluid into wash tub 108. The term "wash fluid" refers to a liquid used for washing and/or rinsing articles during an operating cycle and may include any combination of water, detergent, fabric softener, bleach, and other wash additives or treatments.

In addition, washing machine appliance 52 includes a wash basket 114 that is positioned within wash tub 108 and generally defines an opening 116 for receipt of articles for washing. More specifically, wash basket 114 is rotatably mounted within wash tub 108 such that it is rotatable about an axis of rotation A. According to the illustrated embodiment, the axis of rotation A is substantially parallel to the vertical direction V. In this regard, washing machine appliance 52 is generally referred to as a "vertical axis" or "top load" washing machine appliance 52. However, it should be appreciated that aspects of the present subject matter may be used within the context of a horizontal axis or front load washing machine appliance as well. As used herein, terms of approximation, such as "approximately," "substantially," or "about," refer to being within a ten percent margin of error.

As illustrated, cabinet 102 of washing machine appliance 52 has a top panel 118. Top panel 118 defines an opening (FIG. 2) that coincides with opening 116 of wash basket 114 to permit a user access to wash basket 114. Washing machine appliance 52 further includes a door 120 which is rotatably mounted to top panel 118 to permit selective access to opening 116. In particular, door 120 selectively rotates between the closed position (as shown in FIGS. 1 and 3) and the open position (as shown in FIG. 2). In the closed position, door 120 inhibits access to wash basket 114. Conversely, in the open position, a user can access wash basket 114. A window 122 in door 120 permits viewing of wash basket 114 when door 120 is in the closed position, e.g., during operation of washing machine appliance 52. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIGS. 2 and 3, wash basket 114 further defines a plurality of perforations 126 to facilitate fluid communication between an interior of wash basket 114 and wash tub 108. In this regard, wash basket 114 is spaced apart from wash tub 108 to define a space for wash fluid to escape wash chamber 110. During a spin cycle, wash fluid within articles of clothing and within wash chamber 110 is urged through perforations 126 wherein it may collect in a sump 128 defined by wash tub 108. Washing machine appliance 52 further includes a pump assembly 130 (FIG. 3) that is located beneath wash tub 108 and wash basket 114 for gravity assisted flow when draining wash tub 108.

An impeller or agitation element 132 (FIG. 3), such as a vane agitator, impeller, auger, oscillatory basket mechanism, or some combination thereof is disposed in wash basket 114 to impart an oscillatory motion to articles and liquid in wash basket 114. More specifically, agitation element 132 extends into wash basket 114 and assists agitation of articles disposed within wash basket 114 during operation of washing machine appliance 52, e.g., to facilitate improved cleaning. In different embodiments, agitation element 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitation element 132 and wash basket 114 are oriented to rotate about axis of rotation A (which is substantially parallel to vertical direction V).

As best illustrated in FIG. 3, washing machine appliance 52 includes a drive assembly 138 in mechanical communication with wash basket 114 to selectively rotate wash basket 114 (e.g., during an agitation or a rinse cycle of washing machine appliance 52). In addition, drive assembly 138 may also be in mechanical communication with agitation element 132. In this manner, drive assembly 138 may be configured for selectively rotating or oscillating wash basket 114 and/or agitation element 132 during various operating cycles of washing machine appliance 52.

More specifically, drive assembly 138 may generally include one or more of a drive motor 140 and a transmission assembly 142, e.g., such as a clutch assembly, for engaging and disengaging wash basket 114 and/or agitation element 132. According to the illustrated embodiment, drive motor 140 is a brushless DC electric motor, e.g., a pancake motor. However, according to alternative embodiments, drive motor 140 may be any other suitable type or configuration of motor. For example, drive motor 140 may be an AC motor, an induction motor, a permanent magnet synchronous motor, or any other suitable type of motor. In addition, drive assembly 138 may include any other suitable number, types, and configurations of support bearings or drive mechanisms.

Referring still to FIGS. 1 through 3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of washing machine appliance 52 is controlled by a controller or processing device 62 that is operatively coupled to control panel 150 for user manipulation to select washing machine cycles and features. In response to user manipulation of control panel 150, controller 62 operates the various components of washing machine appliance 52 to execute selected machine cycles and features. According to an exemplary embodiment, controller 62 may include a memory and microprocessor, such as a general or special purpose microprocessor operable to execute programming instructions or micro-control code associated with methods described herein. Alternatively, controller 62 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of washing machine appliance 52 may be in communication with controller 62 via one or more signal lines or shared communication busses.

During operation of washing machine appliance 52, laundry items are loaded into wash basket 114 through opening 116, and washing operation is initiated through operator manipulation of input selectors 152. Wash basket 114 is filled with water and detergent and/or other fluid additives via primary dispenser 112. One or more valves can be controlled by washing machine appliance 52 to provide for filling wash tub 108 and wash basket 114 to the appropriate level for the amount of articles being washed and/or rinsed. By way of example for a wash mode, once wash basket 114 is properly filled with fluid, the contents of wash basket 114 can be agitated (e.g., with agitation element 132 as discussed previously) for washing of laundry items in wash basket 114.

More specifically, referring again to FIG. 3, a water fill process will be described according to an exemplary embodiment. As illustrated, washing machine appliance 52 includes a water supply conduit 160 that provides fluid communication between a water supply source 162 (such as a municipal water supply) and a discharge nozzle 164 for directing a flow of water into wash chamber 110. In addition, washing machine appliance 52 includes a water fill valve or water control valve 166 which is operably coupled to water supply conduit 160 and communicatively coupled to controller 62. In this manner, controller 62 may regulate the operation of water control valve 166 to regulate the amount of water within wash tub 108. In addition, washing machine appliance 52 may include one or more pressure sensors 170 for detecting the amount of water and or clothes within wash tub 108. For example, pressure sensor 170 may be operably coupled to a side of tub 108 for detecting the weight of wash tub 108, which controller 62 may use to determine a volume of water in wash chamber 110 and a subwasher load weight.

After wash tub 108 is filled and the agitation phase of the wash cycle is completed, wash basket 114 can be drained, e.g., by drain pump assembly 130. Laundry articles can then be rinsed by again adding fluid to wash basket 114 depending on the specifics of the cleaning cycle selected by a user. The impeller or agitation element 132 may again provide agitation within wash basket 114. One or more spin cycles may also be used as part of the cleaning process. In particular, a spin cycle may be applied after the wash cycle and/or after the rinse cycle in order to wring wash fluid from the articles being washed. During a spin cycle, wash basket 114 is rotated at relatively high speeds to help wring fluid from the laundry articles through perforations 126. After articles disposed in wash basket 114 are cleaned and/or washed, the user can remove the articles from wash basket 114, e.g., by reaching into wash basket 114 through opening 116.

Figure 4:
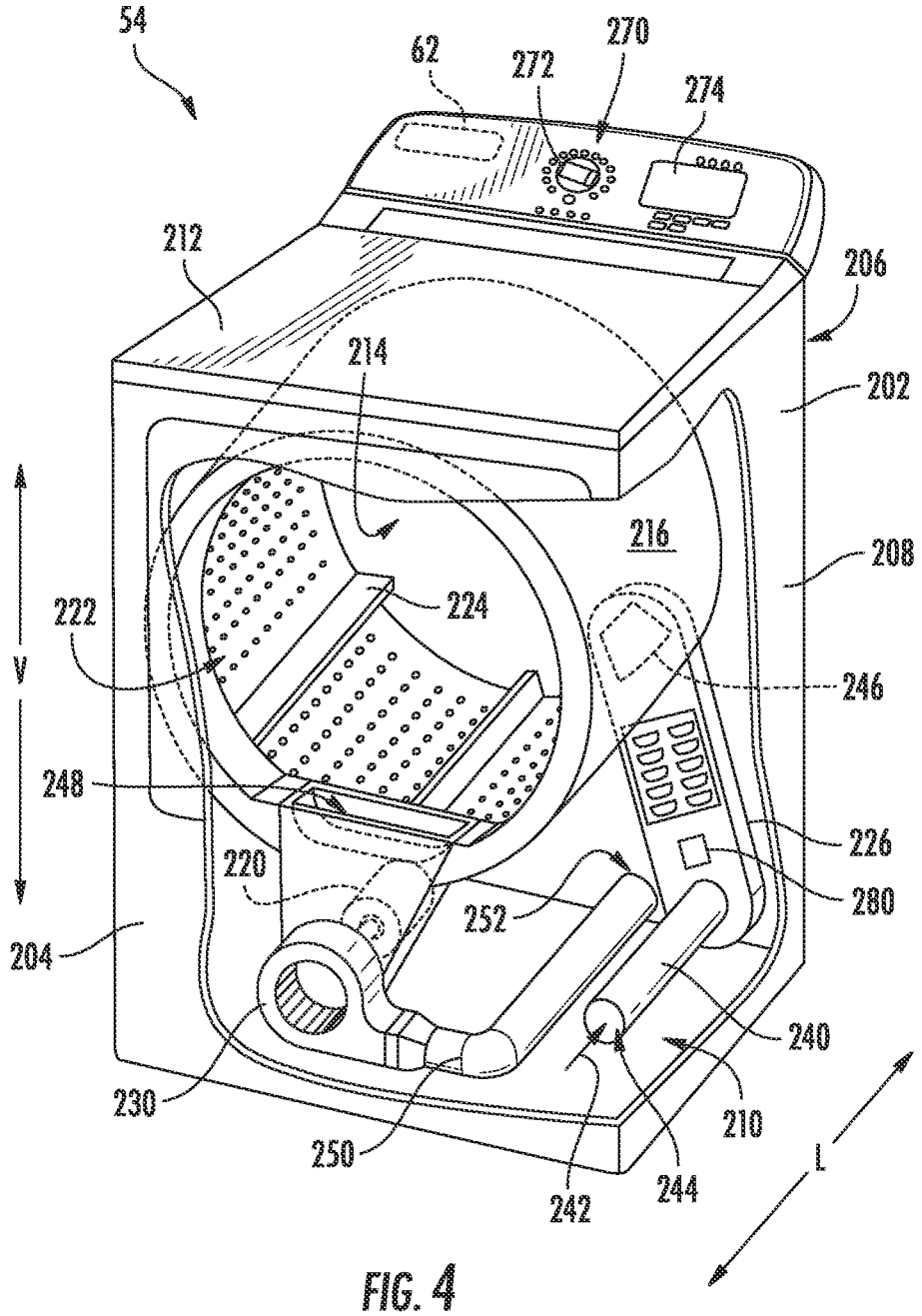
FIG. 4 provides a perspective view of the exemplary dryer appliance of FIG. 1 with portions of a cabinet of the dryer appliance removed to reveal certain components of the dryer appliance.

Referring now to FIG. 4, a perspective view of dryer appliance 54 is provided with a portion of a cabinet or housing 202 of dryer appliance 54 removed in order to show certain components of dryer appliance 54. While described in the context of a specific embodiment of dryer appliance 54, using the teachings disclosed herein it will be understood that dryer appliance 54 is provided by way of example only. Other dryer appliances having different appearances and different features may also be utilized with the present subject matter as well. Dryer appliance 54 defines a vertical direction V, a lateral direction L, and a transverse direction T. The vertical direction V, lateral direction L, and transverse direction T are mutually perpendicular and form an orthogonal direction system.

Cabinet 202 includes a front panel 204, a rear panel 206, a pair of side panels 208 spaced apart from each other by front and rear panels 204 and 206, a bottom panel 210, and a top cover 212. Within cabinet 202 is a drum or container 216 mounted for rotation about a substantially horizontal axis, e.g., that is parallel or substantially parallel to the lateral direction L. Drum 216 defines a chamber 214 for receipt of articles, e.g., clothing, linen, etc., for drying. Drum 216 extends between a front portion and a back portion, e.g., along the lateral direction L.

A motor 220 is configured for rotating drum 216 about the horizontal axis, e.g., via a pulley and a belt (not shown). Drum 216 is generally cylindrical in shape, having an outer cylindrical wall or cylinder and a front flange or wall that defines an entry 222 of drum 216, e.g., at the front portion of drum 216, for loading and unloading of articles into and out of chamber 214 of drum 216. A plurality of tumbling ribs 224 are provided within chamber 214 of drum 216 to lift articles therein and then allow such articles to tumble back to a bottom of drum 216 as drum 216 rotates. Drum 216 also includes a back or rear wall, e.g., such that drum 216 is rotatable on its rear wall as will be understood by those skilled in the art. A duct 226 is mounted to the rear wall of drum 216 and receives heated air that has been heated by a heating assembly or system 240.

Motor 220 is also in mechanical communication with an air handler 230 such that motor 220 rotates air handler 230, e.g., a centrifugal fan. Air handler 230 is configured for drawing air through chamber 214 of drum 216, e.g., in order to dry articles located therein as discussed in greater detail below. In alternative exemplary embodiments, dryer appliance 54 may include an additional motor (not shown) for rotating air handler 230 independently of drum 216.

Drum 216 is configured to receive heated air that has been heated by a heating assembly 240, e.g., in order to dry damp articles disposed within chamber 214 of drum 216. Heating assembly 240 includes a heating element (not shown), such as a gas burner or an electrical resistance heating element, for heating air. As discussed above, during operation of dryer appliance 54, motor 220 rotates drum 216 and air handler 230 such that air handler 230 draws air through chamber 214 of drum 216 when motor 220 rotates. In particular, ambient air (identified herein generally by reference numeral 242) enters heating assembly 240 via an entrance 244 due to air handler 230 urging such ambient air into entrance 244. Such ambient air is heated within heating assembly 240 and exits heating assembly 240 as heated air 242. Air handler 230 draws such heated air through duct 226 to drum 216. The heated air enters drum 216 through an outlet 246 of duct 226 positioned at the rear wall of drum 216.

Within chamber 214, the heated air can accumulate moisture, e.g., from damp articles disposed within chamber 214. In turn, air handler 230 draws humid air through a trap duct 248 which contains a screen filter (not shown) which traps lint particles. Such humid air then passes through trap duct 248 and air handler 230 before entering an exhaust conduit 250. From exhaust conduit 250, such humid air passes out of dryer appliance 54 through a vent 252 defined by cabinet 202. After the clothing articles have been dried, they are removed from the drum 216 via entry 222. A door 260 provides for closing or accessing drum 216 through entry 222.

A user interface panel 270 is positioned on a cabinet backsplash and includes a cycle selector knob 272 that is in communication with a processing device or controller (such as a controller 62). Signals generated in controller 62 operate motor 220, air handler, 230, and heating assembly 240 in response to the position of selector knobs 272. User interface panel 270 may further conclude additional indicators, a display screen, a touch screen interface 174, etc. for providing information to a user of the dryer appliance 54 and receiving suitable operational feedback. Alternatively, a touch screen type interface, knobs, sliders, buttons, speech recognition, etc., mounted to cabinet backsplash or at any other suitable location to permit a user to input control commands for dryer appliance 54 and/or controller 62.

Controller 62 may include memory and one or more processing devices such as microprocessors, CPUs or the like, such as general or special purpose microprocessors operable to execute programming instructions or micro-control code associated with operation of dryer appliance 54. The memory can represent random access memory such as DRAM, or read only memory such as ROM or FLASH. The processor executes programming instructions stored in the memory. The memory may be a separate component from the processor or may be included onboard within the processor. Alternatively, controller 62 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

In general, controller 62 is in operative communication with various components of dryer appliance 54. In particular, controller 62 is in operative communication with motor 220 and heating assembly 240. Thus, upon receiving an activation signal from cycle selector knob 272, controller 62 can activate motor 220 to rotate drum 216 and air handler 230. Controller 62 can also activate heating assembly 240 in order to generate heated air for drum 216, e.g., in the manner described above.

Controller 62 is also in communication with a thermal or temperature sensor 280, e.g., a thermocouple or thermistor. Temperature sensor 280 is configured for measuring a temperature of heated air within duct 226. Temperature sensor 280 can be positioned at any suitable location within dryer appliance 54. For example, temperature sensor 280 may be positioned within or on duct 226. Controller 62 can receive a signal from temperature sensor 280 that corresponds to a temperature measurement of heated air within duct 226, e.g., a temperature measurement of heated air exiting duct 226 at outlet 246.

Now that the construction of system 50, washing machine 52, dryer appliance 54, and external communication system 60 have been presented according to exemplary embodiments, an exemplary method 300 of operating a system of laundry appliances will be described. Although the discussion below refers to the exemplary method 300 of operating system 50 to improve the operation of dryer appliance 54, one skilled in the art will appreciate that the exemplary method 300 is applicable to the monitoring and control of any suitable system of laundry appliances. In exemplary embodiments, the various method steps as disclosed herein may be performed by controllers 62, remote server 68, and/or a separate, dedicated controller.

Figure 5:
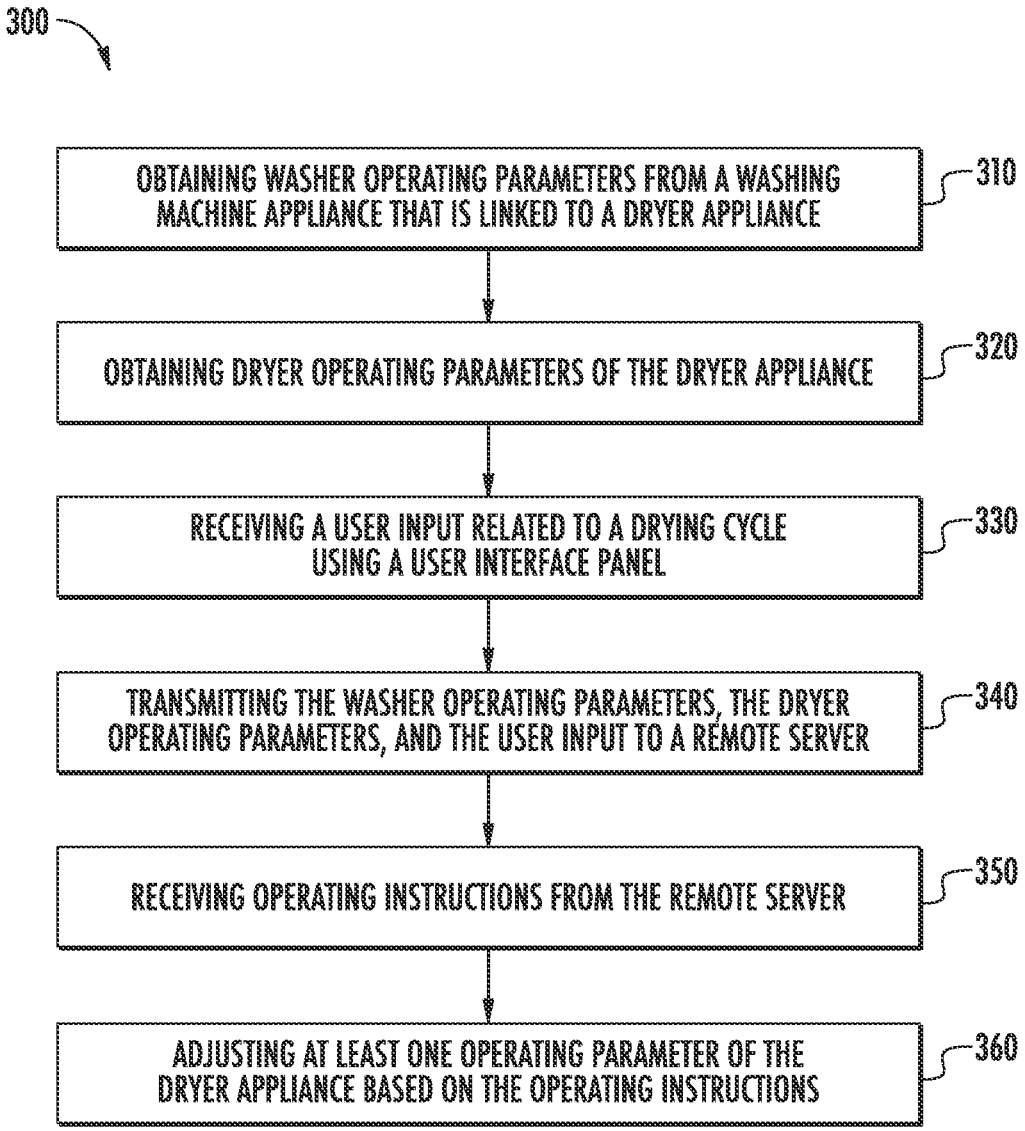
FIG. 5 provides a method of operating a dryer appliance according to an exemplary embodiment of the present subject matter.

Referring generally to FIG. 5, a method of operating a dryer appliance in a laundry system is provided. According to exemplary embodiments, method 300 includes, at step 310, obtaining washer operating parameters from a washing machine appliance that is linked to a dryer appliance. As used herein, the term "washer operating parameters" and the like is generally intended to refer to any cycle selection, operating parameter, load characteristic, performance characteristic, or other qualitative or quantitative measure or data related to the operation of washing machine appliance 52 and/or the clothes washed therein.

For example, according to an exemplary embodiment, the washer operating parameters that are obtained from washing machine appliance 52 may include at least one of a load type, a load weight (dry or wet load weight), a remaining moisture content (RMC), or any other operating parameter or characteristic that is implemented or monitored by washing machine appliance 100. According to still other exemplary embodiments, the washer operating parameters comprise a washer cycle type or any other suitable input that may be selected by the user of the appliance or determined by controller 62 based on load sensing processes.

It should be appreciated that the washer operating parameters that are received from washing machine appliance 52 may be transmitted to dryer appliance 54 in any suitable manner. For example, the washer operating parameters may be obtained from remote server 68 or over network 64. In this regard, washing machine appliance 52 may transmit these washer operating parameters to the network 64 or remote server 68 when measured or selected, and dryer appliance 54 may periodically pull or download these parameters from the network 64. According to still other embodiments, dryer appliance 54 may be in direct wireless communication with washing machine appliance 52, e.g., via a Wi-Fi or Bluetooth connection. According to such an embodiment, the washer operating parameters are received directly from washing machine appliance 52. According to still other embodiments, washer operating parameters may be transferred in any other suitable manner, e.g., via user input, a wired connection, etc.

Step 320 includes obtaining dryer operating parameters of the dryer appliance. As used herein, the term "dryer operating parameters" and the like is generally intended to refer to any cycle selection, operating parameter, load characteristic, performance characteristic, or other qualitative or quantitative measure or data related to the operation of dryer appliance 54 and/or the clothes dried therein. For example, according to an exemplary embodiment, the dryer operating parameter may include a vent restriction level, e.g., a measure of the flow restriction within chamber 214, duct 226, etc. Notably, this vent restriction level may affect the drying operation or efficiency during subsequent drying cycles. Other potential dryer operating parameters may include heating capacity of heating assembly 240, the airflow capacity of air handler 230, etc.

Step 330 includes receiving a user input related to a drying cycle using a user interface panel. In this regard, for example, a user may interact with user interface panel 270 to set desirable operating characteristic, load types, etc. related to a drying cycle. For example, according to an exemplary embodiment, the user input may be a dryness level for the drying cycle, e.g., damp, less dry, normal, more dry, etc. According to still other embodiments, these user inputs may include any other input received through user interface panel 270, consumer device 66, etc. These may include any other dryer settings or other drying parameter modifiers.

Step 340 includes transmitting the washer operating parameters, the dryer operating parameters, and the user input to a remote server. Although the exemplary embodiment refers to the transfer of all of these parameters and input, it should be appreciated that aspects of the present subject matter may include transferring fewer than all of these parameters or may alternatively include the transfer of additional parameters. These parameters and input may be transferred by dryer appliance 54 or washing machine appliance 52 (e.g., via controllers 62) to remote server 68.

Step 350 includes receiving operating instructions from the remote server. In this regard, aspects of the present subject matter are directed to offloading much of the detailed data, computationally intensive tables, transfer functions, and algorithms off of local controllers (e.g., off of controllers 62) and onto remote server 68. On remote server 68, such computations may be performed in a more efficient manner while freeing up local storage space, speeding up processing speed, and generally improving the operation of controllers 62 and dyer appliance 54 in general. As used herein, the term "operating instructions" and the like is intended to refer to the operational feedback received from remote server 68 regarding a drying cycle. In this regard, operating instructions may include operating parameters, parameter modifiers, or other suitable instructions for improved dryer operation.

In this regard, according to exemplary embodiments, the operating instructions are determined at the remote server based on a database stored on the remote server. For example, the database may include parametric tables relating the washer operating parameters of the washing machine appliance and the dryer operating parameters of the dryer appliance to the operating instructions. According to still other embodiments, remote server 68 may include transfer functions that generate optimal dryer parameter modifiers for improved dryer operation, e.g., based at least in part on the inputs supplied at step 340. For example, the operating instructions may include a target voltage of a heating assembly. Notably, by moving such complex computations to the cloud, important processing power and on-board memory and parameter storage on controllers 62 may be saved for local operations.

Notably, if operating instructions are commonly received from remote server 68, e.g., because the inputs transferred at step 340 are the same or very similar, these operating instructions may be stored on a local memory device, e.g., on controller 62. In this regard, controller 62 may be configured for determining that the operating instructions for a given set of washer operating parameters and dryer operating parameters are frequently received (e.g., based on the repeat frequency within a predetermined number of cycles) and storing the operating instructions associated with those input parameter on a local memory device. In this manner, when controller 62 detects subsequent occurrence of the same washer operating parameters and dryer operating parameters, controller 62 may implement the stored operating instructions instead of seeking such instructions from remote server 68.

Step 360 includes adjusting at least one operating parameter of the dryer appliance based on the operating instructions. For example, controller 62 may be configured for implementing the operating instructions by modifying or setting various dryer operating parameters. As used herein, an "operating parameter" of dryer appliance 54 is any cycle setting, operating time, component setting, heat level, part configuration, or other operating characteristic that may affect the performance of dryer appliance 54. Thus, references to operating parameter adjustments or "adjusting at least one operating parameter" are intended to refer to control actions intended to improve dryer performance based on the operating instructions received from the remote server. For example, adjusting a target voltage of a heating assembly, adjusting the fan speed of an air handler, adjusting a spin rate of the drum, extending the drying time, etc., based at least in part on the operating instructions. Other operating parameter adjustments are possible and within the scope of the present subject matter.

FIG. 5 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 300 are explained using system 50 as an example, it should be appreciated that these methods may be applied to the operation of any suitable system of laundry appliances and a remote network or server This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance comprising:

a cabinet;

a drum rotatably mounted within the cabinet, the drum defining a chamber for receipt of clothes for drying; and a controller communicatively coupled to a cloud-based remote server that is located at a distant location from the dryer appliance, the controller being configured to:

obtain washer operating parameters from a washing machine appliance that is linked to the dryer appliance;

obtain dryer operating parameters of the dryer appliance;

transmit the washer operating parameters and the dryer operating parameters to the remote server;

receive operating instructions from the remote server; and adjust at least one operating parameter of the dryer appliance based on the operating instructions.

2. The dryer appliance of claim 1, wherein the washer operating parameters are obtained from the remote server.

3. The dryer appliance of claim 1, wherein the dryer appliance is in wireless communication with the washing machine appliance, and wherein the washer operating parameters are received directly from the washing machine appliance.

4. The dryer appliance of claim 1, wherein the washer operating parameters comprise at least one of a load type, a load weight, or a remaining moisture content.

5. The dryer appliance of claim 1, wherein the washer operating parameters comprise a washer cycle type.

6. The dryer appliance of claim 1, further comprising:

a user interface panel, wherein the controller is in operative communication with the user interface panel and is further configured to:

receive a user input related to a drying cycle using the user interface panel; and transmit the user input to the remote server, wherein the operating instructions are based at least in part on the user input.

7. The dryer appliance of claim 6, wherein the user input is a dryness level for the drying cycle.

8. The dryer appliance of claim 1, wherein the dryer operating parameters of the dryer appliance comprise a vent restriction level.

9. The dryer appliance of claim 1, wherein the operating instructions are determined at the remote server based on a database stored on the remote server.

10. The dryer appliance of claim 9, wherein the database includes parametric tables relating the washer operating parameters of the washing machine appliance and the dryer operating parameters of the dryer appliance to the operating instructions.

11. The dryer appliance of claim 1, further comprising:

a heating assembly for providing a flow of heated air into the chamber, wherein the operating instructions comprises a target voltage of a heating assembly.

12. The dryer appliance of claim 1, wherein the controller is further configured to:

determine that the operating instructions for a given set of washer operating parameters and dryer operating parameters are frequently received; and storing the operating instructions on a local memory device.

13. A method of operating a dryer appliance, the dryer appliance comprising a drum rotatably mounted within a cabinet, the drum defining a chamber for receipt of clothes for drying, the method comprising:

obtaining washer operating parameters from a washing machine appliance that is linked to the dryer appliance;

obtaining dryer operating parameters of the dryer appliance;

transmitting the washer operating parameters and the dryer operating parameters to a cloud-based remote server that is located at a distant location from the dryer appliance;

receiving operating instructions from the remote server; and adjusting at least one operating parameter of the dryer appliance based on the operating instructions.

14. The method of claim 13, wherein the washer operating parameters are obtained from the remote server.

15. The method of claim 13, wherein the dryer appliance is in wireless communication with the washing machine appliance, and wherein the washer operating parameters are received directly from the washing machine appliance.

16. The method of claim 13, wherein the washer operating parameters comprise at least one of a load type, a load weight, or a remaining moisture content.

17. The method of claim 13, wherein the washer operating parameters comprise a washer cycle type.

18. The method of claim 13, further comprising:

receiving a user input related to a drying cycle using a user interface panel; and transmitting the user input to the remote server, wherein the operating instructions are based at least in part on the user input.

19. The method of claim 18, wherein the user input is a dryness level for the drying cycle.

20. The method of claim 13, wherein the dryer operating parameters of the dryer appliance comprise a vent restriction level.

* * * * *